US007422550B1

(12) United States Patent
Pinero et al.

(10) Patent No.: US 7,422,550 B1
(45) Date of Patent: Sep. 9, 2008

(54) GAIT TRAINER

(76) Inventors: Michelle Pinero, 377 W. Hubbard Ave., Columbus, OH (US) 43215; Andrea Roth, 2400 McVey Ct., Columbus, OH (US) 43235

( * ) Notice: Subject to any disclaimer, the term of this patent is extended or adjusted under 35 U.S.C. 154(b) by 734 days.

(21) Appl. No.: 10/945,302

(22) Filed: Sep. 20, 2004

(51) Int. Cl.
*A63B 22/00* (2006.01)
*A63B 22/20* (2006.01)

(52) U.S. Cl. ..... 482/68; 482/66; 135/65; 135/67; 297/5; 280/87.021

(58) Field of Classification Search ..... 482/6, 482/7, 66–71, 78, 80, 124, 126, 142, 143, 482/145; 434/255; 119/770; 601/23, 24, 601/27, 29, 33–35; 280/87.021, 87.051; 297/5, 6; 135/67
See application file for complete search history.

(56) References Cited

U.S. PATENT DOCUMENTS

| | | | | | |
|---|---|---|---|---|---|
| 2,010,482 | A | * | 8/1935 | Cobb | 623/31 |
| 2,210,269 | A | * | 8/1940 | Taylor | 601/33 |
| 2,679,116 | A | * | 5/1954 | Holcombe | 434/250 |
| 3,256,035 | A | * | 6/1966 | Garringer | 297/6 |
| 4,018,440 | A | | 4/1977 | Deutsch | 482/68 |
| 4,162,101 | A | | 7/1979 | McCague, Sr. et al. | 297/6 |
| 4,280,578 | A | | 7/1981 | Perkins | 180/6.5 |
| 4,510,956 | A | | 4/1985 | King | 482/68 |
| 4,621,804 | A | | 11/1986 | Mueller | 280/87.041 |
| 4,779,881 | A | | 10/1988 | Baker | 280/242.1 |
| 4,809,997 | A | | 3/1989 | Owens | 280/211 |
| 4,890,853 | A | | 1/1990 | Olson | 280/87.021 |
| 4,893,826 | A | | 1/1990 | Ward et al. | 280/87.021 |
| 5,020,560 | A | | 6/1991 | Turbeville | 135/67 |
| 5,040,556 | A | | 8/1991 | Raines | 135/67 |
| 5,044,355 | A | | 9/1991 | Reopelle | 128/25 B |
| 5,224,562 | A | | 7/1993 | Reed | 180/6.5 |
| 5,301,968 | A | | 4/1994 | Ward et al. | 280/87.021 |
| 5,348,336 | A | | 9/1994 | Fernie et al. | 280/641 |
| 5,364,120 | A | | 11/1994 | Shimansky | 280/650 |
| 5,378,215 | A | | 1/1995 | Harkins | 482/67 |
| 5,390,753 | A | | 2/1995 | Parker | 180/19.1 |
| 5,397,171 | A | | 3/1995 | Leach | 297/484 |
| 5,406,758 | A | | 4/1995 | Baum | 52/169.5 |

(Continued)

OTHER PUBLICATIONS

Rifton, Pacer Gait Trainer Product Guide, 2 pp.

(Continued)

*Primary Examiner*—LoAn H. Thanh
*Assistant Examiner*—Oren Ginsberg
(74) *Attorney, Agent, or Firm*—Roger A. Gilcrest

(57) ABSTRACT

The present invention is a gait therapy device which facilitates the lower extremities particularly the action of flexion at the hip and knee to aid a patient in assisted ambulation, as well as knee, foot and ankle action. The gait trainer apparatus comprises: (a) a moveable frame adapted to move along the ground; (b) at least one motion responsive wheel attached to the frame and adapted to contact the ground and to turn as the frame moves along the ground, and at least one wheel having an offset motion portion having a right side and left side; (c) a left foot attachment, the left foot attachment connected to the left side of the offset motion portion by a flexible or elastic member; and (d) a right foot attachment, the right foot attachment connected to the right side of the offset motion portion by a flexible or elastic member.

6 Claims, 3 Drawing Sheets

U.S. PATENT DOCUMENTS

| | | | | | |
|---|---|---|---|---|---|
| 5,467,793 | A | | 11/1995 | Hart | 135/67 |
| 5,538,489 | A | | 7/1996 | Magid | 482/54 |
| 5,569,129 | A | | 10/1996 | Seif-Naraghi et al. | 482/69 |
| 5,588,456 | A | * | 12/1996 | Hart | 135/67 |
| 5,676,388 | A | | 10/1997 | Bertani | 280/87.041 |
| 5,706,845 | A | | 1/1998 | Beyar et al. | 135/67 |
| 5,732,964 | A | | 3/1998 | Durham et al. | 280/266 |
| 5,758,371 | A | | 6/1998 | VanDyke et al. | 5/86.1 |
| 5,765,323 | A | | 6/1998 | Bevilacqua | 52/169.5 |
| 5,794,388 | A | | 8/1998 | Jackman | 52/169.5 |
| 5,795,269 | A | | 8/1998 | Bawtree et al. | 482/66 |
| 5,803,103 | A | | 9/1998 | Haruyama | 135/67 |
| 5,813,948 | A | | 9/1998 | Quigg et al. | 482/67 |
| 5,852,906 | A | | 12/1998 | Kuban | 52/302.1 |
| 5,924,960 | A | | 7/1999 | Cohen | 482/51 |
| 5,930,272 | A | | 7/1999 | Thesling | 714/752 |
| 5,941,800 | A | * | 8/1999 | Laconis | 482/70 |
| 5,961,541 | A | | 10/1999 | Ferrati | 607/49 |
| 6,135,931 | A | | 10/2000 | Padula, II et al. | 482/74 |
| 6,161,860 | A | | 12/2000 | Corneau | 280/642 |
| 6,234,982 | B1 | | 5/2001 | Aruin | 600/595 |
| 6,250,409 | B1 | | 6/2001 | Wells | 180/9.52 |
| 6,273,844 | B1 | | 8/2001 | Kelsey et al. | 482/54 |
| 6,302,828 | B1 | | 10/2001 | Martin et al. | 482/69 |
| 6,325,023 | B1 | | 12/2001 | Elnatan | 119/770 |
| 6,343,802 | B1 | | 2/2002 | Workman et al. | 280/87.041 |
| 6,428,033 | B1 | | 8/2002 | Harrison et al. | 280/644 |
| 6,550,190 | B2 | | 4/2003 | Ruiz et al. | 52/169.5 |
| 6,578,594 | B1 | | 6/2003 | Bowen et al. | 135/67 |
| 6,607,202 | B1 | | 8/2003 | Palmer | 280/87.021 |
| 6,619,001 | B1 | | 9/2003 | Pratt | 52/169.5 |
| 6,663,317 | B1 | | 12/2003 | Williams et al. | 405/48 |
| 6,679,570 | B2 | | 1/2004 | Kamikawa | 305/145 |
| 6,689,075 | B2 | | 2/2004 | West | 601/23 |
| 7,150,722 | B1 | * | 12/2006 | Tyrrell | 602/23 |
| 2002/0049122 | A1 | | 4/2002 | Mercado et al. | 482/57 |
| 2002/0082711 | A1 | | 6/2002 | Kuhn et al. | 623/27 |
| 2003/0064869 | A1 | | 4/2003 | Reinkensmayer et al. | 482/100 |
| 2003/0093021 | A1 | | 5/2003 | Goffer | 602/23 |
| 2003/0141691 | A1 | | 7/2003 | Perena | 280/250.1 |
| 2003/0141692 | A1 | | 7/2003 | Perena | 280/250.1 |
| 2004/0073149 | A1 | | 4/2004 | Okediji | |
| 2004/0079405 | A1 | | 4/2004 | Sanders et al. | 135/67 |

OTHER PUBLICATIONS

Kaye Products, Inc., Kaye Reverse Walker product info., 1 pp.
Kaye Products, Inc., Kaye All-Terain Wheels, product info., 1 page (dated Jun. 11, 2004), http://www.cplqld.org.au/ets/otherproducts/walking/kaye/atwheels.
Kaye Products, Inc., Kaye Anterior Chest Support Walker, product info., 1 page, (dated Jun. 11, 2004), http://www.cplqld.org.au/ets/otherproducts/walking/kaye/chest.
Kaye Products, Inc., Kaye Suspension Walkers, 1 page (dated Jun. 11, 2004), http://wwwkayeproducts.com/sw7.html.
Sammons, Preston, Rolyan, product info., 12 pp.
Alimed Inc., product info., 3 pp.

* cited by examiner

GAIT TRAINER

FIELD OF INVENTION

The present invention relates to a therapeutic aid, more particularly, the present invention relates to a therapeutic aid for gait training that facilitates hip and knee flexion resulting in forward propulsion.

BACKGROUND OF THE INVENTION

Many disabled persons, particularly children with neurological disorders and chromosomal/genetic disorders such as cerebral palsy have difficulty in learning to walk. However, several types of equipment are available to provide therapy and training to facilitate walking of such patients.

There are a number of walker type devices which help to support the patient as he or she is attempting walking, some are wheeled, some are motorized, some unweight the patient by using upright harnesses. However, problems arise when the disabled individuals are unable to actively facilitate the required hip and knee flexion necessary for appropriate reciprocal strides needed for forward propulsion.

In addition, it is also desirable to be able to provide a gait trainer that allows the therapist to maintain proper posture while assisting the patient.

The present invention represents an improvement over prior gait trainers and similar devices, such as those described in the following U.S. Pat. Nos. 5,930,272 and 5,765,323 to Bevilacqua; 5,406,758 to Baum; 5,794,388 to Jackman; 5,852,906 to Kuban; 6,550,190 B2 to Ruiz et al.; 6,619,001 to Pratt and 6,663,317 B1 to Williams et al., all of which are hereby incorporated hereby by reference.

BRIEF DESCRIPTION OF THE PRESENT INVENTION

It is an object of the present invention to provide a gait therapy device, which facilitates the lower extremities particularly the action of flexion at the hip and knee to aid a patient in assisted ambulation, as well as knee, foot and ankle action.

In general terms, the present invention includes a gait trainer apparatus comprising: (a) a moveable frame adapted to move along the ground; (b) at least one motion responsive wheel attached to the frame and adapted to contact the ground and to turn as the frame moves along the ground, and at least one wheel having an offset motion portion having a right side and left side; (c) a left foot attachment, the left foot attachment connected to the left side of the offset motion portion by a flexible or elastic member; and (d) a right foot attachment, the right foot attachment connected to the right side of the offset motion portion by a flexible or elastic member. That is, the invention includes an offsetting circular motion device mounted on a mobile frame, the offsetting circular motion device connected to the lower extremities (such as at the foot, ankle, toes or heels) by an elastic or flexible member that allows the foot to be unweighted as it moves along its path, which facilitates hip and knee flexion along with assisting the patient in achieving proper stride motion and length.

The frame may be of any material appropriate to the intended purpose, that being to support a patient while attempting to walk. These materials include metals, plastics and carbon fiber. The frame preferably has a lower portion to which wheels are attached and preferably an upper portion at a height at or above standing hip height for support. Support may be provided by handles for the walker, as well as a seat, sling, anti-scissoring device or chest prompt for upper body support, as are known in the art.

The motion responsive wheel(s) comprise(s) preferably a first motion responsive wheel positioned so as to turn in response to the movement of the frame along the ground, and a second motion responsive wheel connected to the first wheel so as to turn in response to the turning of the first wheel, the second wheel comprising the offset motion portion.

The gait trainer apparatus of the present invention may have support wheels on the frame or sliding members adapted to permit the frame respectively to roll or slide across the ground as the patient moves the frame during gait training. Preferably, the mobile frame will have at least three wheels and preferably at least four wheels to facilitate movement of the frame along a support surface.

The gait trainer apparatus of the present invention may comprise a seat of the type typically used in gait training devices. These may be mounted on the frame and for example may be similar to a bicycle seat or a sling-type seat. The elastic members may be any member sufficient to provide an upward and forward motion to the foot as it cycles through each step. These members may include a material selected from the group consisting of springs, elastic polymeric bands, and flexible metal bands. As an alternative, any flexible band or rope material that is of sufficient strength to transmit the required force from the offset motion wheel, regardless of its degree of elasticity, where the ability of the device to store energy is not of concern.

The left and right attachments may be of any mechanical arrangement required to effect connection to the feet, such as an ankle strap, foot cuff, shoe fixture or cleat, etc. These connections typically will allow the forward and upward motion of the device to be transmitted to the feet as it cycles through each step during use of the device.

In a preferred embodiment, the gait trainer apparatus of the invention comprises: (a) a moveable frame adapted to move along the ground, the frame comprising support wheels; (b) motion responsive wheel(s) attached to the frame and adapted to contact the ground and to turn as the frame moves along the ground, and the motion responsive wheel(s) having an offset motion portion having a right side and left side, and the motion responsive wheel(s) comprising a first motion responsive wheel positioned so as to turn in response to the movement of the frame along the ground, and a second motion responsive wheel connected to the first wheel so as to turn in response to the turning of the first wheel, the second wheel comprising the offset motion portion; (c) a left foot attachment, the left foot attachment connected to the left side of the offset motion portion by a flexible or elastic member; and (d) a right foot attachment, the right foot attachment connected to the right side of the offset motion portion by a flexible or elastic member.

It is preferred that the first motion responsive wheel is positioned above the second motion responsive wheel, and that the first motion responsive wheel is connected to second motion responsive wheel by a belt. The present invention may also include any other mechanical arrangement to transfer the motion of a first such wheel to a second such wheel, such as through the use of gears or connecting rods, or even a motor actuated and controlled by movement of the first such wheel, such that the first motion responsive wheel moves in response to the motion of the second motion responsive wheel. It is preferred that the first motion responsive wheel is disposed high enough such that the offset motion pulls the extremity both forward and upward.

In other terms, the gait trainer apparatus of the present invention may be understood as comprising: (a) a moveable frame adapted to move along the ground so as to produce translational movement in a forward direction; (b) motion conversion means for converting the translational movement in a forward direction to a forward and backward motion; (c) a left foot attachment, the left foot attachment connected to the motion conversion means by a flexible or elastic member; and (d) a right foot attachment, the right foot attachment connected to the motion conversion means by a flexible or elastic member.

The motion conversion means may be any mechanical means for causing reciprocating motion to be brought to bear on the feet in response to movement of the frame. This may be through the use of wheels, rods, gears and the like designed to take energy from the translational movement of the frame, or may even be the use of a motor to provide such reciprocating motion and that is actuated in response to translational movement of the frame.

In operation, the frame is moved forward by the patient. The movement of the frame causes the motion responsive wheel to move in response. The motion of the motion responsive wheel causes the offset motion wheel to move to urge the patient's rearmost foot to be pulled upward and forward through the elastic member connection.

The unweighting of the rearmost foot allows the elastic member connector to cause the attached foot to be drawn forward so as to result in a movement of the foot along the intended proper gait path. That path ends when the foot completes the step and returns to contact the ground. The subsequent forward propulsion of the moveable frame by the patient who pushes off from that foot that has now moved to the forwardmost position causes the cycle to repeat with respect to the other foot, and therefore allowing for an offsetting of the unweighting of each foot in a continuous fashion.

Preferably, the offsetting circular motion will be created by the material that interconnects a device to a grounded wheel. This may be a belt, series of gears (i.e. arranged to translate the motion of the motion responsive wheel such that the motion of the frame is translated into a corresponding upward and forward force that continues through the desired stride length).

It will also be understood that the width of the connections to the offset motion wheel will be sized so as to accord with the distance between the feet of the user.

Preferably, the diameter (d) of the grounded wheel determines stride length (I) of the individual patient by $\frac{1}{2}\pi d=1$. The wheel(s) may be made to be either interchangeable to vary the desired stride length, or the wheels may be provided with extension portions to increase their outside diameter to increase the stride length as necessary. These extensions may be provided in a kit together with additional motion-transmissive bands as necessary.

Preferably, the flexible/elastic connectors attached to the above the device and to the individual's lower extremities, will be made by a semi-rigid material that tolerates force of the offsetting motion, such as plastic, rubber or metal.

Preferably, the wheels will have a lock/anti-lock mechanism to control the direction of gait.

Preferably, the frame may further include optional features such as support bars in position to be gripped by the hands of a user, rotating handlebars to control direction, arm prompts to provide proper upper extremity positioning, seating support system to provide proper pelvic alignment, chest harness for trunk control, and an anti-scissoring device.

BRIEF DESCRIPTION OF THE DRAWINGS

Having thus generally described the nature of the invention, reference will now be made to the accompanying drawings showing by way of illustration a preferred embodiment, and in which.

DETAILED DESCRIPTION OF THE PREFERRED EMBODIMENT

In view of the foregoing summary, the following describes the preferred embodiment of the present invention, which is presently considered to be the best mode of the invention.

Figure 1:
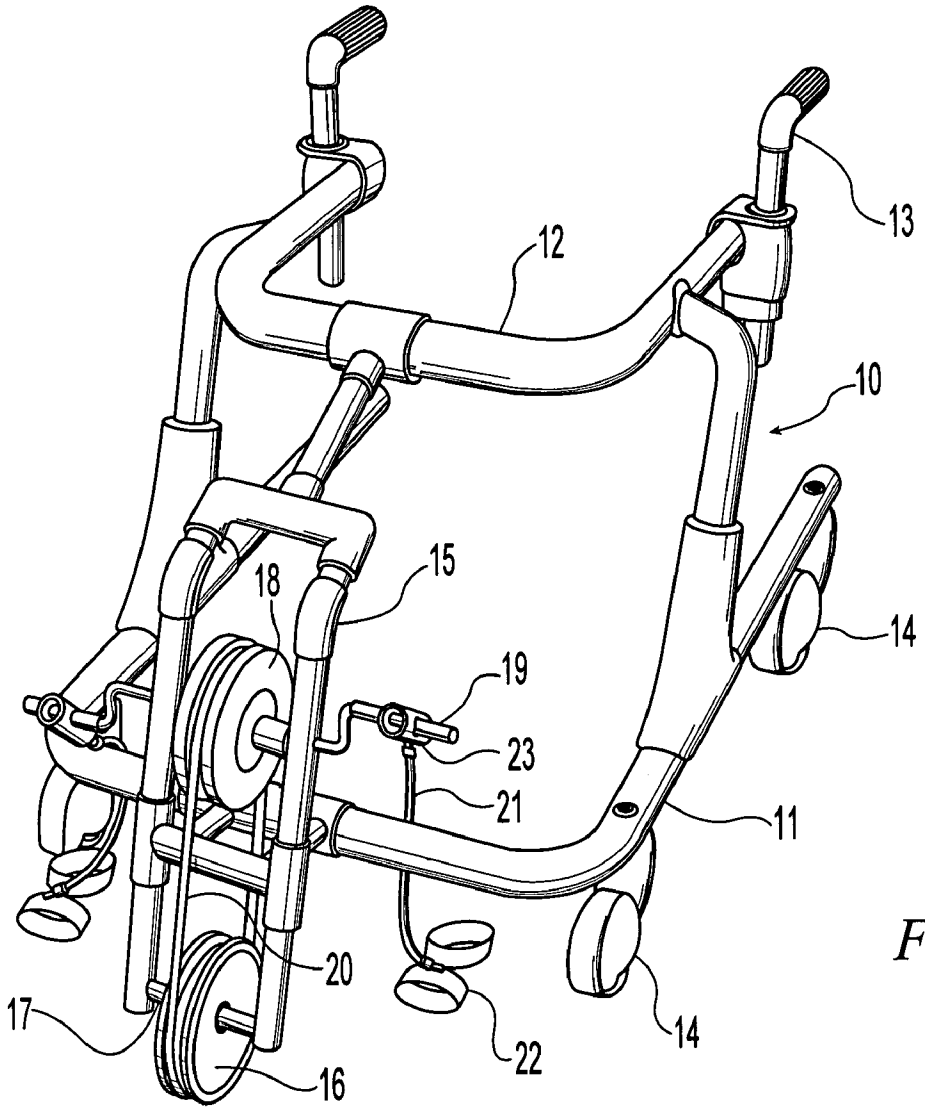
FIG. 1 is a front perspective view of a gait trainer in accordance with one embodiment of the present invention.

Referring to FIG. 1, the present invention comprises of a main frame 10 which in the illustration is made up of rigid interconnecting tubes. The frame has lower portion 11 bearing support wheels 14 and upper portion 12, the upper portion connected to handles 13.

Mounted on the frame 10 through fork 15 is a motion responsive wheel 16 with a bearing rod 17 on either end, which allows for circular motion of the motion responsive wheel 16, and when attached to a wheeled frame 10, allows for movement by the walker along a path. The fork may be made to be removably attachable to a frame, so that the motion transmissive assembly may be retrofitted onto an existing walker or gait trainer. This may be done through the use of removable fixtures such as screws, Velcro bands, wing nuts or clamps known in the art.

Also mounted on the frame 10 is the offset motion wheel 18, which is attached to the frame 10 by fork 15. This offset motion wheel 18 is supported by fork 17 and connected via a crank bar 19. When the motion responsive wheel 16 is moved by movement of the frame 10, the motion transmissive cable or band 20 causes the offset motion wheel 18 to turn correspondingly. The size of the wheels and the size of the crank bar accordingly may be sized to arrive at a stride length and cycle frequency. Preferably, the motion responsive wheel 16 and the offset motion wheel 18 are the same size, and the crank bar 19 extends to the outer diameter of the offset motion wheel 18, such that the translational movement of the frame is correspondingly transferred to achieve the appropriate stride length and cycle frequency of the walker.

Attached to the crank bar 19 on each end are elastic tension bands 21, which attach to the crank bar 19 by any appropriate connection that allows the elastic tension bands 21 to freely turn, such as plastic tube portion 23. The elastic tension bands 21 are attached to user's feet through any appropriate connection, such as a foot or ankle cuff 22, a fixture attached to a shoe or an ankle band otherwise designed to transmit the force to the foot to provide the gait-assisting force. Tension from band 21 causes the unweighting of the user's feet in succession and the crank bar 19 moves up and around in a circular path. As the crank bar 19 moves 180 degrees around, the user's foot is brought up and advances forward along the line of the band 21. This offset motion of the crank bar 19 and the linear motion of the attached foot transfers the tension onto the other band. This unweights the opposite foot attached to the other tension band, allowing crank bar 19 to move up and around in a circular motion causing the same affect as previously stated.

Figure 2:
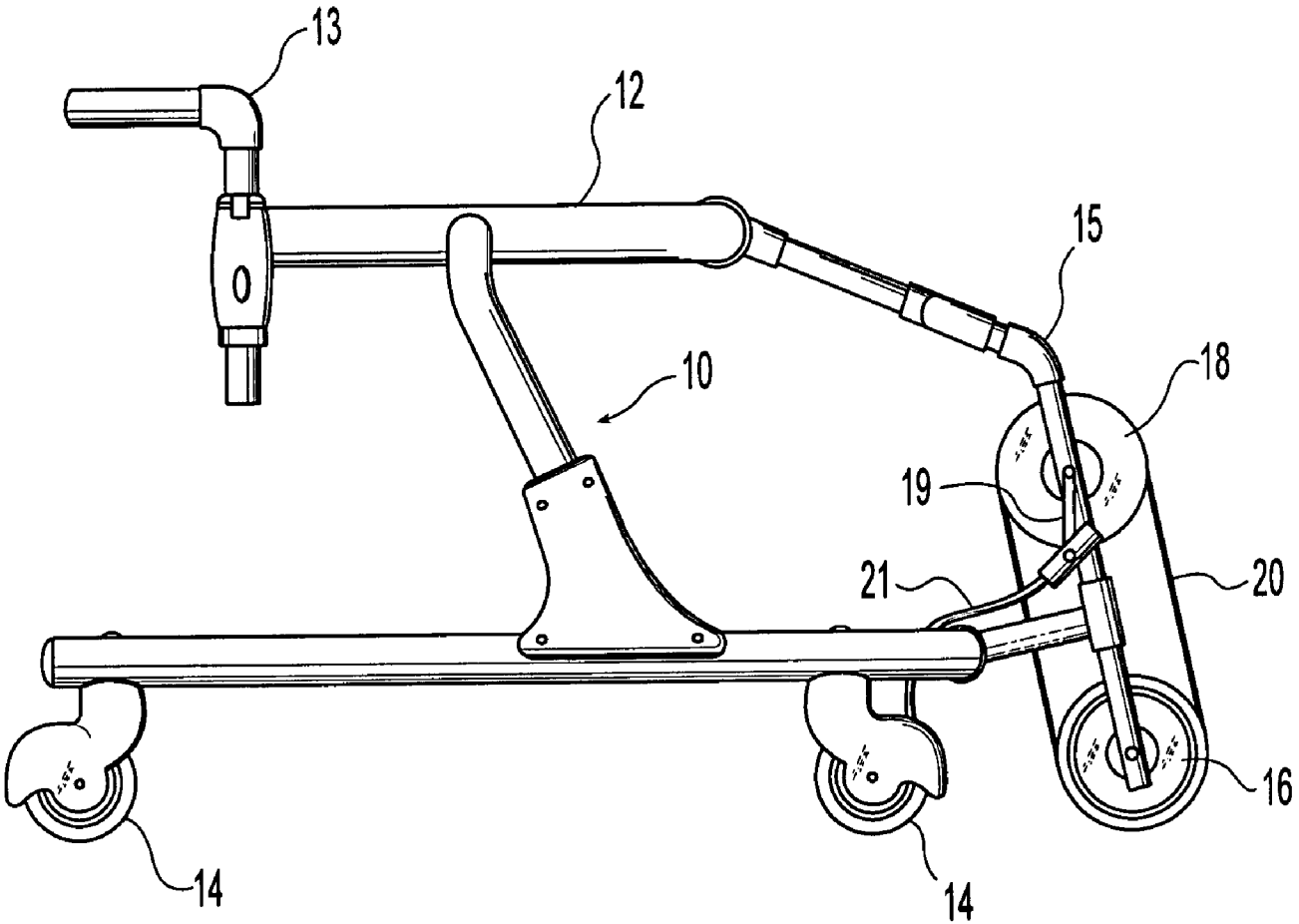
FIG. 2 is a side elevation view of a gait trainer in accordance with one embodiment of the present invention.

FIG. 2 shows a side elevation view of the device shown in FIG. 1 with corresponding number references.

Figure 3:
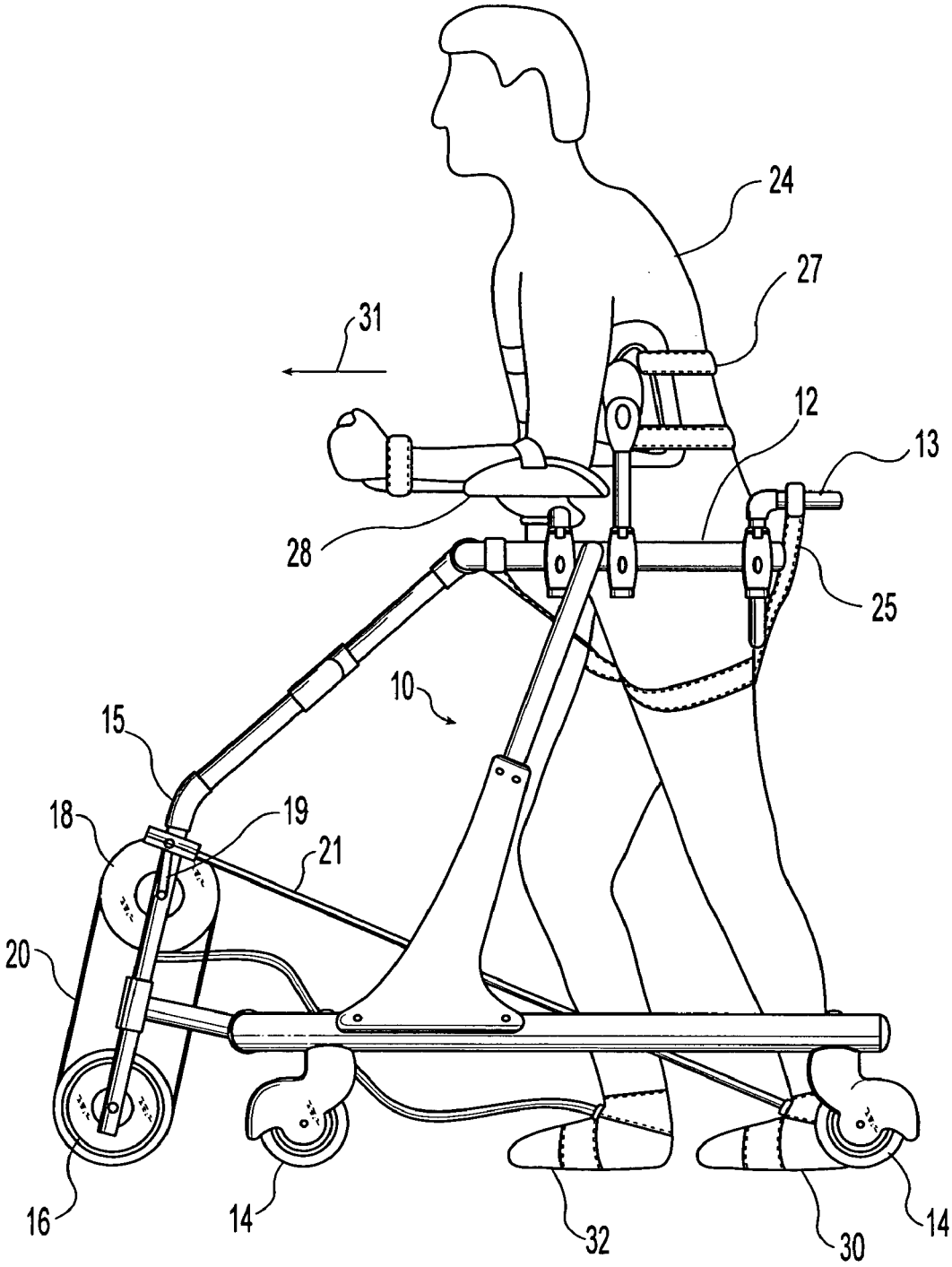
FIG. 3 is a side elevation view of a gait trainer in accordance with one another embodiment of the present invention, showing the position of a user of the present invention as a mobility aid in accordance with the present invention.

FIG. 3 shows a side elevation view of the device similar to that shown in FIGS. 1 and 2 and using the corresponding numerical references from those figures, and shown with an adult-size user 24, and showing the addition of a sling seat 25 attached to the extensions identified as handles 13 in FIGS. 1 and 2, a chest prompt 27 and arm prompts 28 attached to the upper frame portion of the gait trainer 12.

FIG. 3 also shows a user 24 in position in the gait trainer. This Figure shows how the rearmost foot 30 of the user 24 is brought under an upward and forward tension by the cooperative action of the offset motion wheel 18, crank bar 19 and the elastic band 21 as the user urges the frame forward along direction line 31 and the motion is transmitted through the motion responsive wheel 16 to the offset motion wheel 18. As the user begins a step with the rearmost foot 30, the foot is unweighted and guided forward by action of the device. Typically, the device will be constructed such that the flexible/elastic connectors pull at an angle of from about 5 to about 45 degrees from the ground.

As this foot moves to the foremost position past the other foot 32, the user may then urge the frame forward which causes the other foot 32, now in the rearmost position, to be brought under the same upward and forward tension as the foot 30 originally in the rearmost position, as the offset motion wheel 18 is cycled though a half turn as indicated by the formula above.

It will be appreciated that the stride length and the amount of force brought to bear on the foot of each user may be accommodated in any of several ways, such as by size adjustments in the diameter of the wheels, the degree of offset (i.e. the length of the vertical portion of the crank bar 19), the length, material and thickness of the flexible or elastic connectors, or any combination thereof. These types of adjustments may be made depending upon the size, age and disability of the user.

In this regard, the invention may be provided in the form of a kit that may contain a number of the motion responsive wheels, motion transmissive cables or bands, and offset motion wheels of various sizes, crank bars of various widths, and connection members of various materials, lengths and or materials, to be able to assemble the inventive arrangement onto walker frames of any size or architecture. In this way, the invention may be arranged for users that have varying stride length, require additional upward and/or forward motion applied to the foot, or require more or less resiliency applied to the foot through the connector members.

The embodiments above are intended to be illustrative and not limiting. Additional embodiments are within the claims. Although the present invention has been described with reference to preferred embodiments, workers skilled in the art will recognize that changes may be made in form and detail without departing from the spirit and scope of the invention.

What is claimed is:

1. A gait trainer apparatus comprising:

(a) a moveable frame adapted to move along the ground, said frame additionally comprises support wheels;

(b) a first motion responsive wheel adapted to contact the ground and positioned so as to turn in response to the forward movement of said frame along the ground, and a second motion responsive wheel disposed above said first motion responsive wheel and connected to said first motion responsive wheel so as to turn in response to the turning of said first motion responsive wheel, said first motion responsive wheel is connected to said second motion responsive wheel by a belt, said second motion responsive wheel comprising an offset motion portion, said offset motion portion having a right side and left side, said offset motion portion comprising a pair of diametrically opposed cranks;

(c) a left foot attachment, said left foot attachment connected directly to said left side of said offset motion portion by a left connection member comprising an elastic member; and (d) a right foot attachment, said right foot attachment connected directly to said right side of said offset motion portion by a right connection member comprising an elastic member, said elastic member each of a length and connected such that, as said second motion responsive wheel turns, and said frame is moved along the ground by a wearer wearing said left and right foot attachments on his or her respective left and right feet, each of the left and right connection members are stretched, as said wearer walks along said ground, the distance between said left and right foot is repetitively increased and decreased in respective alternating fashion, so as to exert a direct spring force urging in alternating fashion said left foot and right foot forward and toward said offset motion portion.

2. A gait trainer apparatus according to claim 1 wherein said frame additionally comprises sliding members adapted to permit said frame to slide across the ground.

3. A gait trainer apparatus according to claim 1 wherein said frame additionally comprises a seat.

4. A gait trainer apparatus according to claim 1 wherein said left foot attachment and said right foot attachment each comprise a strap.

5. A gait trainer apparatus according to claim 1 wherein said connection elastic members comprise a material selected from the group consisting of springs, elastic polymeric bands, and flexible metal bands, ropes and cords.

6. A gait trainer apparatus according to claim 1 wherein said first motion responsive wheel comprises gear teeth and said second motion responsive wheel comprises gear teeth, and the apparatus comprises a movement connection between gear teeth of said first motion responsive wheel and said gear teeth of said second motion responsive wheel.

* * * * *